US007812276B2

(12) United States Patent
Maloney et al.

(10) Patent No.: US 7,812,276 B2
(45) Date of Patent: Oct. 12, 2010

(54) ELECTRICAL SWITCHING APPARATUS, AND ARC CHUTE AND ARC MEMBER THEREFOR

(75) Inventors: James G. Maloney, Industry, PA (US); Michael J. Erb, Fombell, PA (US)

(73) Assignee: Eaton Corporation, Cleveland, OH (US)

( * ) Notice: Subject to any disclaimer, the term of this patent is extended or adjusted under 35 U.S.C. 154(b) by 239 days.

(21) Appl. No.: 12/108,172

(22) Filed: Apr. 23, 2008

(65) Prior Publication Data

US 2009/0266793 A1 Oct. 29, 2009

(51) Int. Cl.
*H01H 33/20* (2006.01)

(52) U.S. Cl. ..... 218/148; 218/22; 218/34; 218/35; 218/36; 218/37; 218/38; 218/39; 218/40; 218/41; 218/89; 218/99; 218/149; 218/154; 218/155; 218/156; 218/157; 335/16; 335/195; 335/201

(58) Field of Classification Search ..... 218/22, 218/34–41, 89, 99, 148–149, 154–157; 335/16, 335/195, 201
See application file for complete search history.

(56) References Cited

U.S. PATENT DOCUMENTS

| | | | | |
|---|---|---|---|---|
| 2,310,728 | A * | 2/1943 | Bartlett | 218/35 |
| 3,171,936 | A * | 3/1965 | Klein al. | 218/149 |
| 3,202,790 | A * | 8/1965 | Burton | 218/149 |
| 4,229,630 | A | 10/1980 | Wafer et al. | |
| 4,761,626 | A * | 8/1988 | Teraoka | 335/16 |
| 4,973,805 | A * | 11/1990 | Paton et al. | 218/40 |
| 5,569,894 | A * | 10/1996 | Uchida et al. | 218/27 |
| 5,969,314 | A | 10/1999 | Rakus et al. | |
| 6,060,674 | A * | 5/2000 | Malingowski et al. | 200/272 |
| 6,297,465 | B1 | 10/2001 | Groves et al. | |
| 6,417,474 | B1 | 7/2002 | Rakus et al. | |
| 7,034,242 | B1 | 4/2006 | Shea et al. | |
| 7,094,986 | B2 | 8/2006 | Shea | |
| 7,202,436 | B1 | 4/2007 | Zindler | |
| 2004/0016722 | A1 * | 1/2004 | Rademacher et al. | 218/149 |
| 2006/0151437 | A1 * | 7/2006 | Rakus et al. | 218/34 |

* cited by examiner

*Primary Examiner*—Elvin G Enad
*Assistant Examiner*—Mohamed A Musleh
(74) *Attorney, Agent, or Firm*—Martin J. Moran

(57) ABSTRACT

An arc member is provided for an electrical switching apparatus. The electrical switching apparatus includes an operating mechanism for opening and closing separable contacts, and an arc chute disposed proximate the separable contacts to attract an arc generated thereby. The separable contacts include a stationary contact and a movable contact. The stationary contact has an edge, which is disposed in a plane. The arc member includes an arc element disposed between the stationary contact and the arc chute. The arc element has first and second portions and first and second arc attractors. The first arc attractor extends outwardly from the first portion toward the plane of the edge of the stationary contact to draw the arc from the separable contacts to the arc member. The second arc attractors, which are disposed on the second portion of the arc element, direct the arc into the arc chute.

12 Claims, 4 Drawing Sheets

ELECTRICAL SWITCHING APPARATUS, AND ARC CHUTE AND ARC MEMBER THEREFOR

BACKGROUND OF THE INVENTION

1. Field of the Invention

The invention relates generally to electrical switching apparatus and, more particularly, to electrical switching apparatus, such as circuit breakers. The invention also relates to arc chutes for electrical switching apparatus. The invention further relates to arc members for circuit breaker arc chutes.

2. Background Information

Circuit breakers and other electrical switching apparatus (e.g., without limitation, circuit switching devices and other circuit interrupters such as contactors, motor starters, motor controllers and other load controllers) typically include a set of stationary electrical contacts and a set of movable electrical contacts. The stationary and movable contacts are in physical contact with one another when it is desired that the circuit breaker provide electrical current therethrough to a load. When it is desired to interrupt the circuit, however, the movable contacts are moved away from the stationary contacts, thus removing the movable contacts from physical contact with the stationary contacts and creating a space therebetween.

When conducting current, the movement of the movable contacts away from the stationary contacts can result in the formation of an electrical arc in the space between the contacts beginning at the time the contacts are initially separated. Such an arc is undesirable for a number of reasons. For one, it provides a pathway for current to flow through the circuit breaker to the load when it is desired to isolate the load from such current. Additionally, the electrical arc extending between the contacts often results in vaporization or sublimation of the contact material itself, eventually resulting in destruction or pitting of the movable and/or stationary contacts. Thus, it is desirable to eliminate any such arcs as soon as possible.

As shown in FIGS. 1A and 1B, for example, the movable contact 1 is typically mounted on an arm 3 that is contained in a pivoting assembly 5, which pivots the movable contact 1 away from the stationary contact 7. An arc chute 9 is provided along the path of the arm 3 to break up and dissipate such arcs (not shown). The arc chute 9 includes a plurality of spaced apart arc members 11,13 (both shown in FIG. 1A). As the movable contact 1 is moved away from the stationary contact 7, the movable contact 1 moves through at least some of the arc members 11,13 (both shown in FIG. 1A). The arc (not shown) is magnetically urged toward and between the arc members 11,13 (both shown in FIG. 1A). When the arc (not shown) is created, it is more likely to travel along a sharp edge or corner. Accordingly, many arc chute designs employ devices such as, for example, the arc member 11, which in the example of FIGS. 1A and 1B is specifically designed to draw the arc (not shown) into the arc chute 9.

However, at relatively low current levels (e.g., without limitation, about 750 amps), for example, which are associated with an overload condition, there is often insufficient energy to make the arc (not shown) jump to the arc chute 9. For instance, the arc is sometimes attracted to an edge 15 of the stationary contact 7 instead of the arc member 11. It would, therefore, seem logical to position the arc member 11 in as close proximity to the stationary contact 7 as possible, in order to overcome the foregoing disadvantage by facilitating drawing the arc (not shown) to the arc member 11 and, in turn, into the arc chute 9. However, as shown in FIG. 1B, the distance 17 between the arc member 11 and the stationary contact 7 must be at least 0.120 inches. Otherwise, the arc (not shown) would undesirably jump to the arc chute 9 when relatively high current levels (e.g., without limitation, about 22,000 amps), for example, which are associate with a short circuit condition, are experienced. Under such circumstances, a portion of the arc member 11 could vaporize, resulting in a failure to interrupt and/or complete destruction of the arc chamber 19. There is a need, therefore, for an arc member that provides proper circuit interruption under both relatively low current level (e.g., without limitation, about 750 amps) overload conditions and relatively high current level (e.g., without limitation, about 22,000 amps) short circuit conditions.

There is, therefore, room for improvement in electrical switching apparatus, and in arc chutes and arc members therefor.

SUMMARY OF THE INVENTION

These needs and others are met by embodiments of the invention, which are directed to an arc member for the arc chute of an electrical switching apparatus, such as a circuit breaker. The arc member includes a plurality of unique structures and features that enable it to be disposed in close proximity to the stationary electrical contact of the circuit breaker, in order to enable the desired circuit interruption at relatively low current levels (e.g., without limitation, about 750 amps), yet to also provide proper circuit interruption at relatively high current levels (e.g., without limitation, about 22,000 amps).

As one aspect of the invention, an arc member is provided for an electrical switching apparatus. The electrical switching apparatus includes a housing, separable contacts enclosed within the housing, an operating mechanism for opening and closing the separable contacts, and an arc chute disposed proximate the separable contacts in order to attract an arc generated by the separable contacts. The separable contacts include a stationary contact and a movable contact being movable into and out of electrical contact with the stationary contact. The stationary contact has an edge. The edge is disposed in a plane. The arc member comprises: an arc element structured to be disposed between the stationary contact and the arc chute, the arc element including a first portion and a second portion extending outwardly from the first portion; a first arc attractor disposed on the first portion of the arc element, the first arc attractor being structured to extend outwardly from the first portion of the arc element toward the plane of the edge of the stationary contact, in order to draw the arc from the separable contacts to the arc element; and a number of second arc attractors disposed on the second portion of the arc element, the number of second arc attractors being structured to direct the arc into the arc chute.

The first arc attractor may be a projection projecting outwardly from the first portion of the arc element. The projection may include a face disposed distal from the first portion of the arc element, wherein the face is disposed in a plane, and wherein the plane of the face is structured to be parallel with respect to the plane of the edge of the stationary contact. The distance between the plane of the edge of the stationary contact and the plane of the face may be between about 0.02 inches and about 0.04 inches. The arc element may include a first end structured to be disposed proximate the stationary contact of the electrical switching apparatus, and a second end disposed opposite and distal from the first end of the arc element. The projection may be disposed at or about the first end of the arc element.

The second portion of the arc element may comprise a first side member and a second side member. The first side member may be disposed opposite and spaced apart from the second side member, in order that the arc element is generally U-shaped. Each of the first side member and the second side member may have a first end and a second end. The number of second arc attractors may comprise a number of first slots in the first side member between the first end of the first side member and the second end of the first side member, and a number of second slots in the second side member between the first end of the second side member and the second end of the second side member. The number of second arc attractors may further comprise a first protrusion and a second protrusion, wherein the first protrusion is structured to protrude outwardly from the second end of the first side member of the second portion of the arc element toward the arc chute, and wherein the second protrusion is structured to protrude outwardly from the second end of the second side member of the second portion of the arc element toward the arc chute.

As another aspect of the invention, an arc chute is provided for an electrical switching apparatus. The electrical switching apparatus includes a housing, separable contacts enclosed within the housing, and an operating mechanism for opening and closing the separable contacts. The separable contacts include a stationary contact and a movable contact being movable into and out of electrical contact with the stationary contact. The stationary contact has an edge. The edge is disposed in a plane. The arc chute comprises: a number of chute members structured to dissipate an arc generated by the separable contacts; and an arc member comprising: an arc element structured to be disposed between the stationary contact and a corresponding one of the number of chute members, the arc element including a first portion and a second portion extending outwardly from the first portion, a first arc attractor disposed on the first portion of the arc element, the first arc attractor being structured to extend outwardly from the first portion of the arc element toward the plane of the edge of the stationary contact, in order to draw the arc from the separable contacts to the arc element, and a number of second arc attractors disposed on the second portion of the arc element, the number of second arc attractors being structured to direct the arc into the number of chute members of the arc chute.

As another aspect of the invention, an electrical switching apparatus comprises: a housing; separable contacts enclosed within the housing, the separable contacts including a stationary contact and a movable contact being movable into and out of electrical contact with the stationary contact, the stationary contact having an edge, the edge being disposed in a plane; an operating mechanism for opening and closing the separable contacts; and an arc chute disposed proximate to the separable contacts in order to attract an arc generated by the separable contacts, the arc chute comprising: a number of chute members, and an arc member comprising: an arc element disposed between the stationary contact and a corresponding one of the number of chute members, the arc element including a first portion and a second portion extending outwardly from the first portion, a first arc attractor disposed on the first portion of the arc element, the first arc attractor extending outwardly from the first portion of the arc element toward the plane of the edge of the stationary contact, in order to draw the arc from the separable contacts to the arc element, and a number of second arc attractors disposed on the second portion of the arc element, the number of second arc attractors being structured to direct the arc into the arc chute.

The electrical switching apparatus may be a circuit breaker. The housing of the circuit breaker may include a number of vents for exhausting gas associated with the arc, and the number of chute members of the arc chute may be at least one generally U-shaped member, wherein the at least one generally U-shaped member is disposed adjacent to the arc member between the arc member and the number of vents of the housing.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1A:
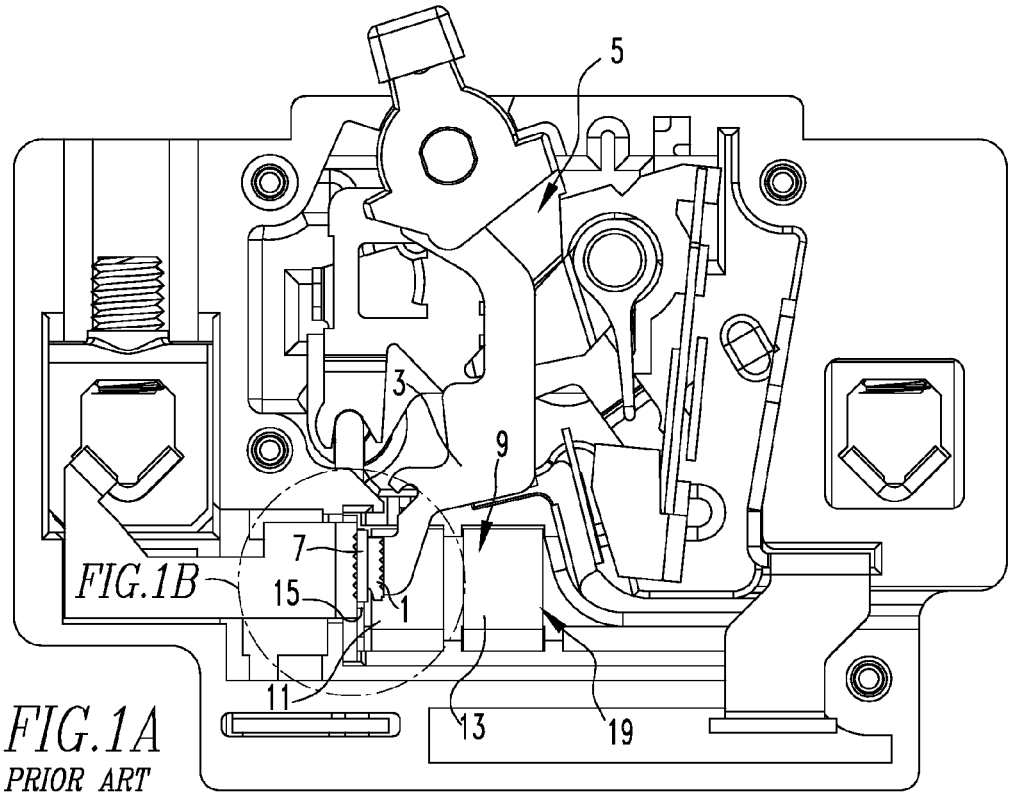
FIG.1A PRIOR ART
FIG. 1A is a side elevation view of a circuit breaker, with a portion of the circuit breaker housing removed to show internal structures.
Figure 1B:
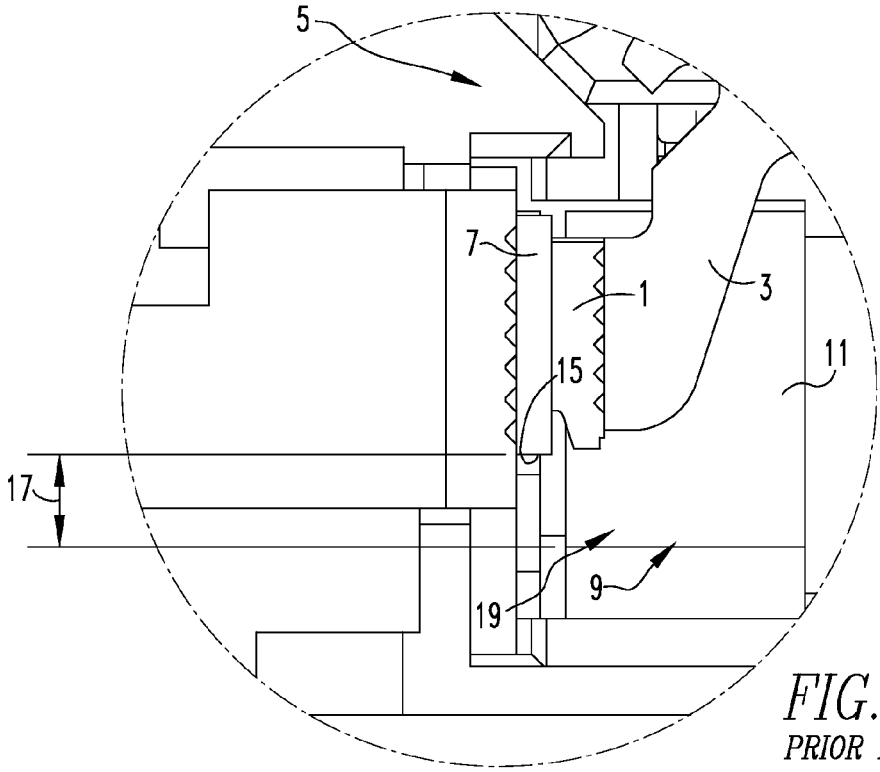
FIG.1B PRIOR ART
FIG. 1B is an enlarged view of the separable contacts and a portion of the arc chute of the circuit breaker of FIG. 1A.

Directional phrases used herein, such as, for example, left, right, front, back, top, bottom and derivatives thereof, relate to the orientation of the elements shown in the drawings and are not limiting upon the claims unless expressly recited therein.

As employed herein, the term "arc attractor" refers to any known or suitable feature, element, structure or combination thereof, which is structured to manipulate (e.g., without limitation, coax; draw; direct; attract) an arc generated by separable contacts of an electrical switching apparatus, and expressly includes, but is not limited to, a slot, a groove, a recess or some other suitable opening, a protrusion, a projection or some other suitable protuberance.

As employed herein, the statement that two or more parts are "coupled" together shall mean that the parts are joined together either directly or joined through one or more intermediate parts.

As employed herein, the term "ionized" means completely or partially converted into ions and electrons and being at least somewhat electrically conductive such as, for example, ionized gases generated by arcing between separable electrical contacts of a circuit breaker when opened.

As employed herein, the term "number" shall mean one or an integer greater than one (i.e., a plurality).

Figure 2:
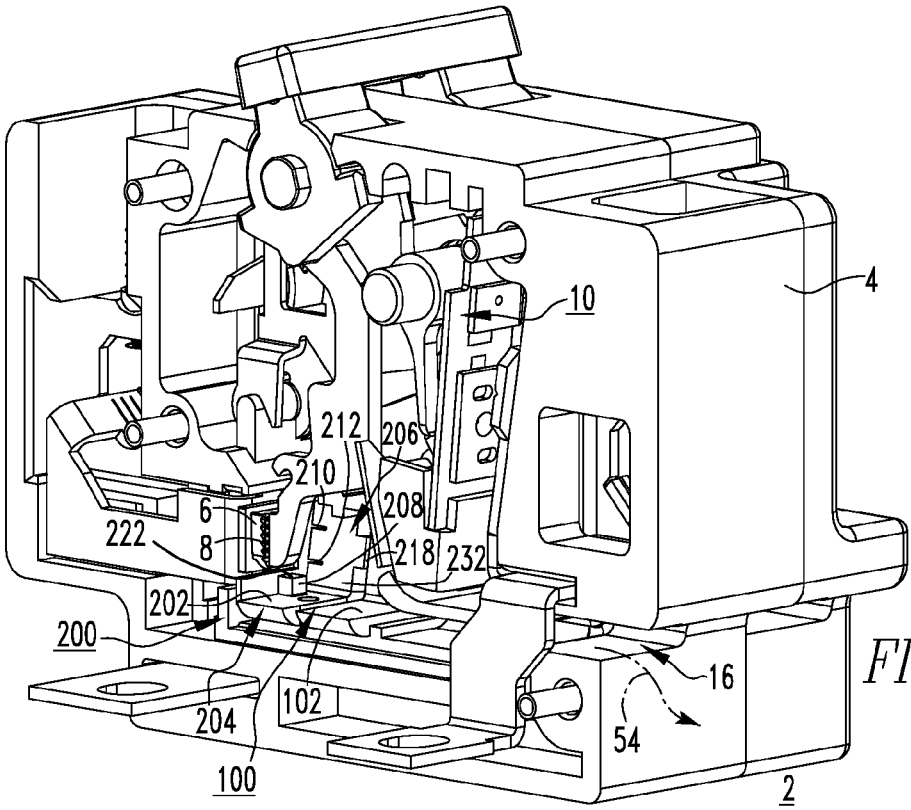
FIG. 2 is an isometric view of a circuit breaker, and an arc chute and an arc member therefor, in accordance with an embodiment of the invention, with portions of the arc chute and arc member cut away to show internal structures.

FIG. 2 shows an electrical switching apparatus 2, such as a circuit breaker, including an arc chute 100 (partially shown in FIG. 2) having an arc member 200 (partially cut away to show internal structures in FIG. 2), in accordance with the invention. The circuit breaker 2 includes a housing 4, a portion of which has been removed in FIG. 2 to show internal structures. Separable electrical contacts 6,8 are enclosed within the housing 4, and include a stationary contact 6, and a movable contact 8 being movable into (shown) and out of (not shown)

electrical contact with the stationary contact 6. An operating mechanism (indicated generally in FIGS. 2 and 3 as reference number 10) is structured to open and close the separable contacts 6,8 in a generally well-known manner.

The arc chute 100 is disposed proximate the separable contacts 6,8, in order to attract an arc (not shown in FIG. 2, but see arrows 50 and 52 of FIG. 7) that is generated by the opening of the separable contacts 6,8, for example and without limitation, in response to an overload condition or short circuit condition of the circuit breaker 2. The arc chute 100 includes a number of chute members 102 (partially shown in FIG. 2; see also FIG. 3). Although a single, generally U-shaped chute member 102 is shown and described herein, it will be appreciated that any known or suitable alternative number and/or configuration of chute members (e.g., 102) could be employed, without departing from the scope of the invention. For example and without limitation, a plurality (not shown) of generally U-shaped members (e.g., 102) could be employed side-by-side. A plurality of conventional arc plates (not shown) could also be employed in combination with the disclosed arc member 200.

Figure 3:
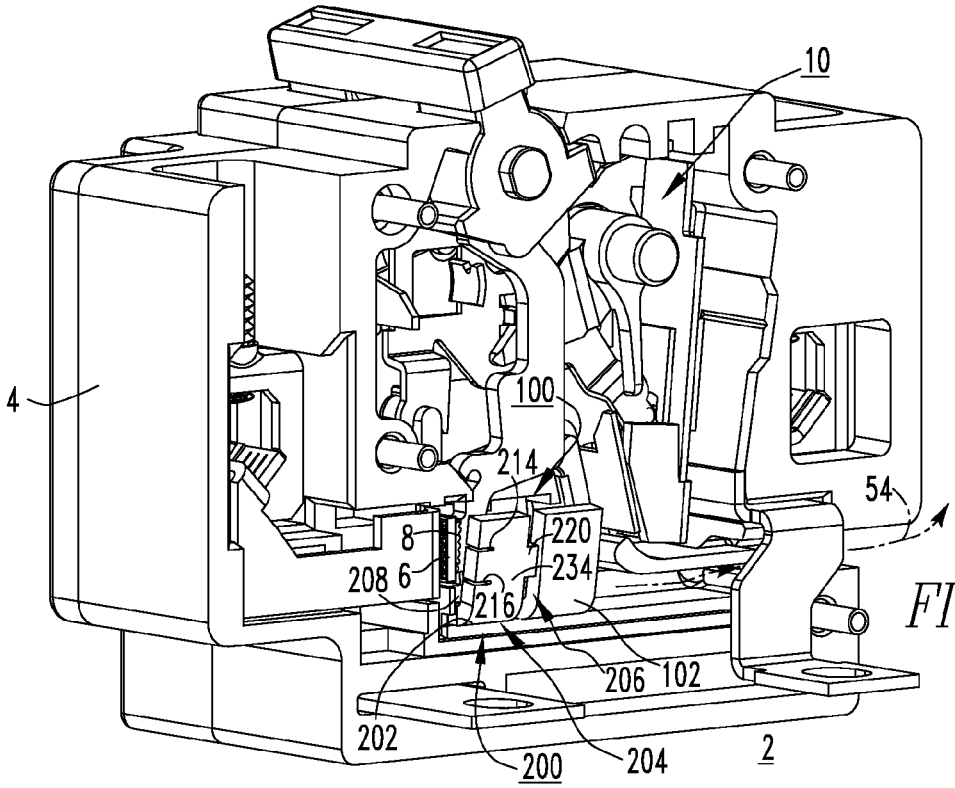
FIG. 3 is an isometric view of the circuit breaker, and arc chute and arc member therefor of FIG. 2.
Figure 4:
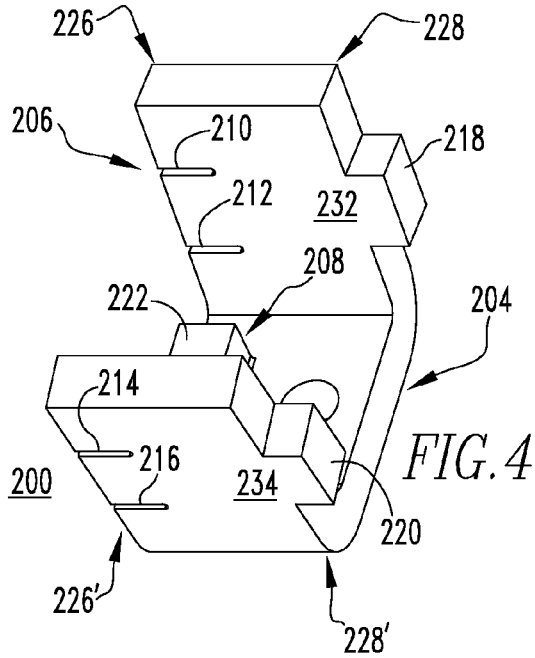
FIG. 4 is an isometric view of the arc member of FIG. 3.
Figure 5:
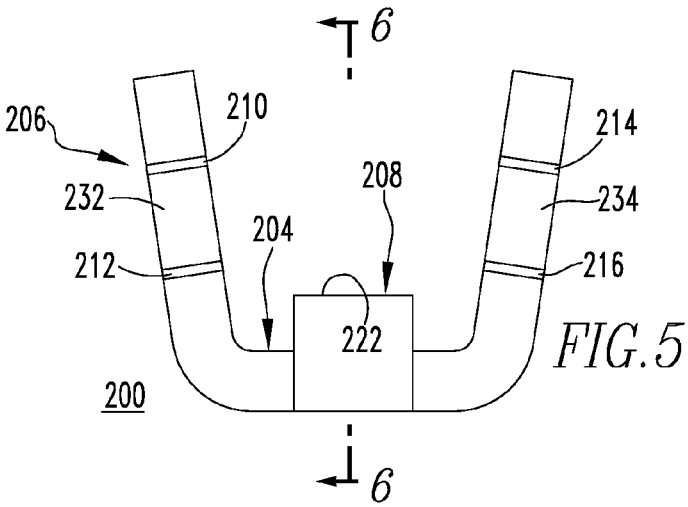
FIG. 5 is an end elevation view of the arc member of FIG. 4.

Continuing to refer to FIG. 2, and also to FIGS. 3-5, it will be appreciated that the disclosed arc member 200 is disposed between the stationary contact 6 and the arc chute 100 and, in particular, the aforementioned generally U-shaped chute member 102 thereof. The arc member 200 includes an arc element 202, which preferably is also generally U-shaped (best shown in FIGS. 4 and 5), and includes a first portion 204 and second portion 206 extending outwardly from the first portion 204. A first arc attractor 208 (partially shown in FIG. 3) extends outwardly from the first portion 204. Specifically, as shown in the enlarged view of FIG. 7, the stationary contact 6 includes an edge 12, which is disposed in a plane 14. The first arc attractor, which in the example shown and described herein is a projection 208 (e.g., without limitation, arc runner), extends from the first portion 204 of the arc element 202 toward such plane 14. More specifically, the projection 208 includes a face 222, which is disposed distal from the first portion 204 in a second, different plane 224. The plane 224 of the projection face 222 is parallel with respect to the plane 14 of the stationary contact edge 12. The face 222 of the projection 208 is the closest feature of the arc element 202 to the stationary contact 6. In one non-limiting embodiment, the distance 18 between the planes 14 and 224 is between about 0.02 and about 0.04 inches, and is preferably about 0.034 inches. As a result of this relatively close proximal relationship between the stationary contact 6 and the projection 208, the arc is drawn (e.g., attracted) from the separable contacts 6,8 to the arc element 202 and, in particular, the projection 208 thereof, for example without limitation, in the event of the relatively low current (e.g., without limitation, about 750 amps) overload condition, as indicated generally by arrow 50, shown in phantom line drawing in FIG. 7.

Figure 7:
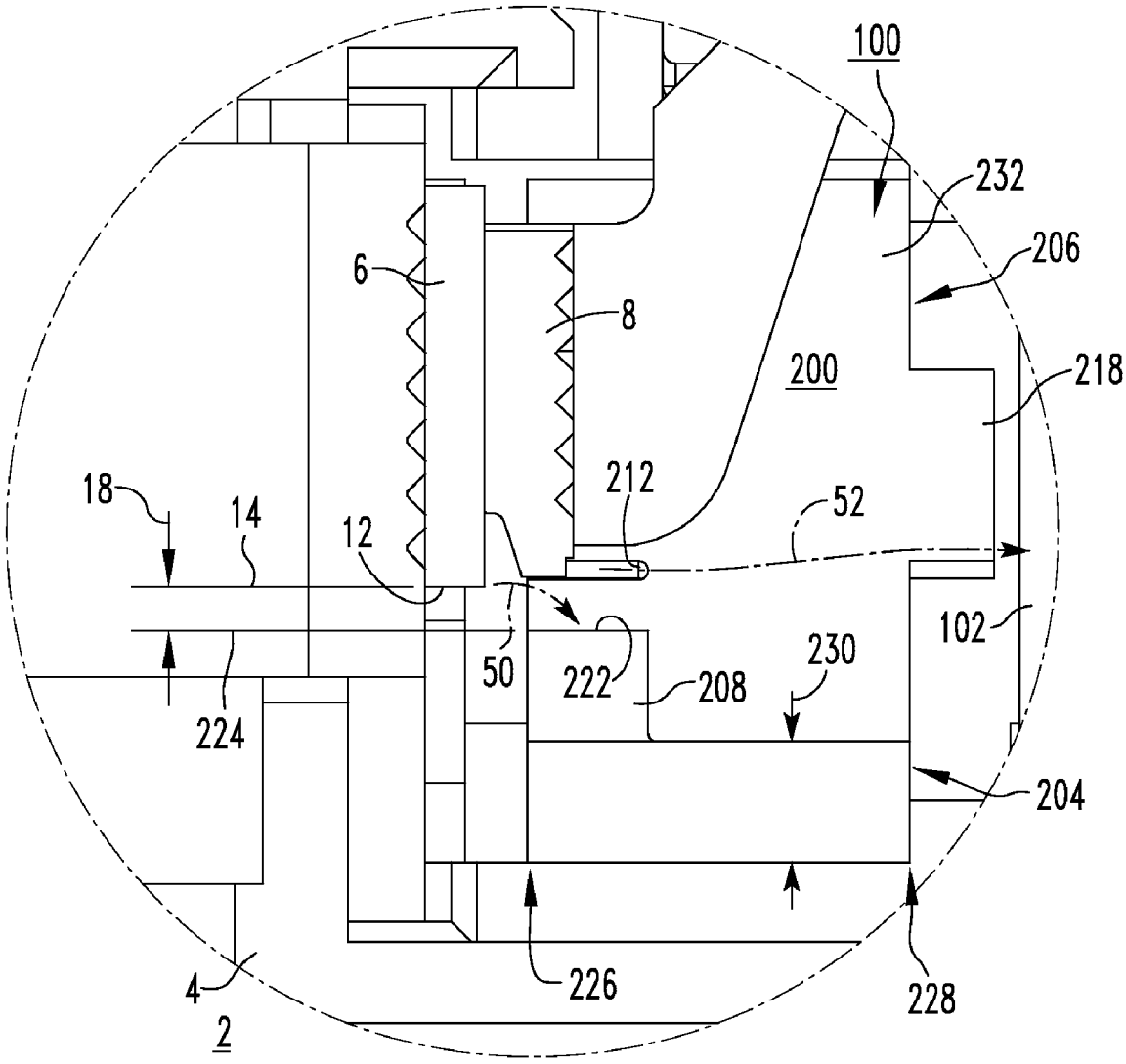
FIG. 7 is an enlarged view of the separable contacts and arc member of the circuit breaker of FIG. 2.

In addition the aforementioned first arc attractor (e.g., projection 208), the example arc element 202 further includes a number of second arc attractors 210,212,214,216,218,220 (all shown in FIG. 4), all of which are disposed on the second portion 206 of the arc element 202, and are structured to direct the arc into the arc chute 100, for example in the event of a relatively high current (e.g., without limitation, about 22,000 amps) short circuit condition, as indicated generally by arrow 52 of FIG. 7.

Figure 6:
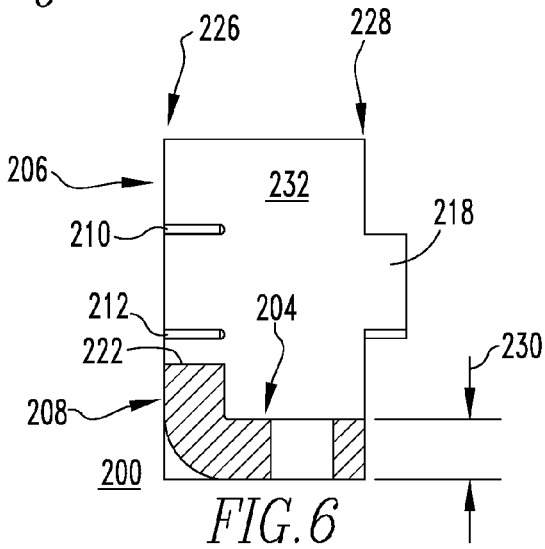
FIG. 6 is a sectional view taken along line 6-6 of FIG. 5.

Specifically, as shown in FIGS. 4-6, first and second opposing and spaced apart side members 232 and 234 extend outwardly from the first portion 204 of the arc element 202, such that the arc element 202 is generally U-shaped, as previously discussed. The first side member 232 includes first and second ends 226 and 228 and the second side member 234 includes first and second ends 226' and 228'. The second arc attractors of the example arc element 202 include a pair of parallel slots 210,212 extending from the first end 226 of the first side member 232 toward the second end 228 of the first side member 232, and a pair of parallel slots 214,216 extending from the first end 226' of the second side member 234 toward the second end 228' of the second side member 234. However, it will be appreciated that any known or suitable alternative number and/or configuration of slots or other suitable second arc attractors, as defined herein, could be employed.

For example, the number of second arc attractors of the arc element 202 shown and described herein further includes a first protrusion 218, which protrudes outwardly from the second end 228 of the first side member 232 of the second portion 206 of the arc element 202, and second protrusion 220 protruding outwardly from the second end 228' of the second side 234 of the second portion 206 of the arc element 202, as shown in FIG. 4. More specifically, as shown in FIGS. 2, 3 and 7, the first and second protrusions 218 (FIGS. 2 and 7), 220 (FIGS. 3 and 4) extend toward the aforementioned generally U-shaped chute member 102 of arc chute 100, thereby directing the arc (see, for example, arrow 52 of FIG. 7) into the arc chute 100. As shown in FIG. 6, the protrusions (first protrusion 218 is shown) are preferably, although not necessarily, aligned with the slots (slots 210 and 212 are shown) of the second portion 206 of the arc element 202. Also shown in FIG. 6, is the fact that the arc element 202 has a thickness 230. In one non-limiting example embodiment, the thickness 230 is at least 0.085 inches, and is preferably about 0.094 inches.

Referring again to FIGS. 2 and 3, the housing 4 of the example circuit breaker 2 includes a number of vents 16 for exhausting gas such as, for example without limitation, ionized gases associated with the arc. The gases are indicated generally in FIGS. 2 and 3 by reference number 54, shown in phantom line drawing. As shown, the arc chute 100 is disposed between the separable contacts 6,8 and the vent 16 of the circuit breaker 2, with the aforementioned generally U-shaped chute member 102 being disposed adjacent to the disclosed arc member 200, between the arc member 200 and the vent 16 of the circuit breaker housing 4. It will be appreciated that the particular number and/or configuration of the vent(s) (e.g., 16) and the particular manner in which the gases 54 are discharged (e.g., expelled) from the circuit breaker housing 4 are not intended to be limiting aspects of the invention.

Accordingly, the disclosed arc member 200 provides a mechanism, which enables the circuit breaker 2 to provide effective electrical current interruption under both relatively low current (e.g., without limitation, about 750 amps) and relatively high current (e.g., without limitation, about 22,000 amps) conditions, as well as any current level therebetween.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An arc member for an electrical switching apparatus, said electrical switching apparatus including a housing, separable contacts enclosed within said housing, an operating mechanism for opening and closing said separable contacts, and an arc chute disposed proximate said separable contacts in order to attract an arc generated by said separable contacts, said separable contacts including a stationary contact and a movable contact being movable into and out of electrical contact with said stationary contact, said stationary contact having an edge, said edge being disposed in a plane, said arc member comprising:

an arc element structured to be disposed between said stationary contact and said arc chute, said arc element including a first portion and a second portion extending outwardly from said first portion;

a first arc attractor disposed on said first portion of said arc element, said first arc attractor being structured to extend outwardly from said first portion of said arc element toward the plane of said edge of said stationary contact, in order to draw said arc from said separable contacts to said arc element; and a number of second arc attractors disposed on said second portion of said arc element, said number of second arc attractors being structured to direct said arc into said arc chute, wherein said first arc attractor is a projection projecting outwardly from said first portion of said arc element; wherein said projection includes a face disposed distal from said first portion of said arc element; wherein said face is disposed in a plane; and wherein the plane of said face of said projection is structured to be parallel with respect to the plane of said edge of said stationary contact, and wherein said second portion of said arc element comprises a first side member and a second side member; and wherein said first side member is disposed opposite and spaced apart from said second side member, in order that said arc element is generally U-shaped, and wherein each of said first side member and said second side member has a first end and a second end; and wherein said number of second arc attractors comprises a number of first slots in said first side member between the first end of said first side member and the second end of said first side member, and a number of second slots in said second side member between the first end of said second side member and the second end of said second side member, and wherein said number of first slots is a first plurality of parallel slots; wherein said first plurality of parallel slots extends from the first end of said first side member toward the second end of said first side member; wherein said number of second slots is a second plurality of parallel slots; and wherein said second plurality of parallel slots extends from the first end of said second side member toward the second end of said second side member.

2. The arc member of claim 1 wherein the distance between the plane of said edge of said stationary contact and the plane of said face of said projection is between about 0.02 inches and about 0.04 inches.

3. The arc member of claim 1 wherein said arc element further includes a first end structured to be disposed proximate said stationary contact of said electrical switching apparatus, and a second end disposed opposite and distal from the first end of said arc element; and wherein said projection is disposed at or about the first end of said arc element.

4. The arc member of claim 1 wherein said number of second arc attractors further comprises a first protrusion and a second protrusion; wherein said first protrusion is structured to protrude outwardly from the second end of said first side member of said second portion of said arc element toward said arc chute; and wherein said second protrusion is structured to protrude outwardly from the second end of said second side member of said second portion of said arc element toward said arc chute.

5. The arc member of claim 4 wherein said first protrusion is aligned with said number of first slots; and wherein said second protrusion is aligned with said number of second slots.

6. The arc member of claim 1 wherein said arc element has a thickness; and wherein said thickness is at least 0.085 inches.

7. An arc chute for an electrical switching apparatus, said electrical switching apparatus including a housing, separable contacts enclosed within said housing, and an operating mechanism for opening and closing said separable contacts, said separable contacts including a stationary contact and a movable contact being movable into and out of electrical contact with said stationary contact, said stationary contact having an edge, said edge being disposed in a plane, said arc chute comprising:

a number of chute members structured to dissipate an arc generated by said separable contacts; and an arc member comprising:

an arc element structured to be disposed between said stationary contact and a corresponding one of said number of chute members, said arc element including a first portion and a second portion extending outwardly from said first portion, a first arc attractor disposed on said first portion of said arc element, said first arc attractor being structured to extend outwardly from said first portion of said arc element toward the plane of said edge of said stationary contact, in order to draw said arc from said separable contacts to said arc element, and a number of second arc attractors disposed on said second portion of said arc element, said number of second arc attractors being structured to direct said arc into said number of chute members of said arc chute, wherein said arc element includes a first end structured to be disposed proximate said stationary contact of said electrical switching apparatus, and a second end disposed opposite and distal from the first end of said arc element; wherein said first arc attractor is a projection projecting outwardly from said first portion of said arc element at or about the first end of said arc element; wherein said projection includes a face disposed distal from said first portion of said arc element; wherein said face is disposed in a plane; and wherein the plane of said face of said projection is structured to be parallel with respect to the plane of said edge of said stationary contact, and wherein said second portion of said arc element comprises a first side member and a second side member; and wherein said first side member is disposed opposite and spaced apart from said second side member, in order that said arc element is generally U-shaped, and wherein each of said first side member and said second side member has a first end and a second end; wherein said number of second arc attractors comprises a number of first slots in said first side member, and a number of second slots in said second side member; wherein said number of first slots extends from the first end of said first side member toward the second end of said first side member; and wherein said number of second slots extends from the first end of said second side member toward the second end of said second side member.

8. The arc chute of claim 7 wherein the distance between the plane of said edge of said stationary contact and the plane of said face of said projection is between about 0.02 inches and about 0.04 inches.

9. The arc chute of claim 7 wherein said number of second arc attractors further comprises a first protrusion and a second protrusion; wherein said number of chute members is at least one generally U-shaped member disposed adjacent to said arc member; wherein said first protrusion protrudes outwardly from the second end of said first side member of said second portion of said arc element, toward a corresponding one of said at least one generally U-shaped member; and wherein said second protrusion protrudes outwardly from the second end of said second side member of said second portion of said arc element, toward said corresponding one of said at least one generally U-shaped member.

10. An electrical switching apparatus comprising:

a housing;

separable contacts enclosed within said housing, said separable contacts including a stationary contact and a movable contact being movable into and out of electrical contact with said stationary contact, said stationary contact having an edge, said edge being disposed in a plane;

an operating mechanism for opening and closing said separable contacts; and an arc chute disposed proximate to said separable contacts in order to attract an arc generated by said separable contacts, said arc chute comprising:

a number of chute members, and an arc member comprising:

an arc element disposed between said stationary contact and a corresponding one of said number of chute members, said arc element including a first portion and a second portion extending outwardly from said first portion, a first arc attractor disposed on said first portion of said arc element, said first arc attractor extending outwardly from said first portion of said arc element toward the plane of said edge of said stationary contact, in order to draw said arc from said separable contacts to said arc element, and a number of second arc attractors disposed on said second portion of said arc element, said number of second arc attractors being structured to direct said arc into said arc chute, wherein said arc element includes a first end disposed proximate to said stationary contact of said electrical switching apparatus, and a second end disposed opposite and distal from the first end of said arc element; wherein said first arc attractor is a projection projecting outwardly from said first portion of said arc element at or about the first end of said arc element; wherein said projection includes a face disposed distal from said first portion of said arc element; wherein said face is disposed in a plane; and wherein the plane of said face of said projection is parallel with respect to the plane of said edge of said stationary contact, and wherein said second portion of said arc element of said arc member comprises a first side member extending outwardly from said first portion of said arc element, and a second side member extending outward from said first portion of said arc element; wherein said first side member is disposed opposite and spaced apart from said second side member, in order that said arc element is generally U-shaped; wherein each of said first side member and said second side member has a first end and a second end; wherein said number of second arc attractors comprises a number of first slots in said first side member, and a number of second slots in said second side member; wherein said number of first slots extends from the first end of said first side member toward the second end of said first side member; and wherein said number of second slots extends from the first end of said second side member toward the second end of said second side member.

11. The electrical switching apparatus of claim 10 wherein said number of second arc attractors of said second portion of said arc element further comprises a first protrusion and a second protrusion; wherein said first protrusion protrudes outwardly from the second end of said first side member of said second portion of said arc element, toward a corresponding one of said number of chute members of said arc chute; and wherein said second protrusion protrudes outwardly from the second end of said second side member of said second portion of said arc element, toward said corresponding one of said number of chute members of said arc chute.

12. The electrical switching apparatus of claim 10 wherein said electrical switching apparatus is a circuit breaker; wherein said housing of said circuit breaker includes a number of vents for exhausting gas associated with said arc; wherein said number of chute members of said arc chute is at least one generally U-shaped member; and wherein said at least one generally U-shaped member is disposed adjacent to said arc member between said arc member and said number of vents of said housing.

* * * * *